US008167087B2

(12) United States Patent
Simeonov et al.

(10) Patent No.: US 8,167,087 B2
(45) Date of Patent: May 1, 2012

(54) MULTIMODAL INDICATOR SAFETY DEVICE FOR LADDER POSITIONING

(75) Inventors: Peter Simeonov, Morgantown, WV (US); Hongwei Hsiao, Morgantown, WV (US); John Powers, Morgantown, WV (US)

(73) Assignee: The United States of America as represented by the Secretary of the Department of Health and Human Services, Centers for Disease Control and Prevention, Washington, DC (US)

( * ) Notice: Subject to any disclaimer, the term of this patent is extended or adjusted under 35 U.S.C. 154(b) by 367 days.

(21) Appl. No.: 12/400,233

(22) Filed: Mar. 9, 2009

(65) Prior Publication Data

US 2010/0224444 A1 Sep. 9, 2010

(51) Int. Cl.
*E06B 5/34* (2006.01)

(52) U.S. Cl. ..... 182/18; 33/366.14

(58) Field of Classification Search ..... 182/13, 182/18; 33/366.14
See application file for complete search history.

(56) References Cited

U.S. PATENT DOCUMENTS

| | | | | |
|---|---|---|---|---|
| 2,845,719 | A * | 8/1958 | Thomiszer | 182/18 |
| 4,554,994 | A | 11/1985 | Weiner | |
| 5,027,522 | A * | 7/1991 | Cagan et al. | 33/366.14 |
| 5,313,713 | A * | 5/1994 | Heger et al. | 33/366.14 |
| 5,376,925 | A * | 12/1994 | Crisafulli et al. | 340/665 |
| 5,680,707 | A * | 10/1997 | Boelling | 33/333 |
| 5,740,881 | A | 4/1998 | Lensak | |
| 5,954,154 | A | 9/1999 | Ziolkowski | |
| 6,152,262 | A | 11/2000 | Jung | |
| 6,349,477 | B1 * | 2/2002 | Hunter | 33/366.14 |
| 6,657,547 | B2 | 12/2003 | Ching-Yao | |
| 7,182,148 | B1 * | 2/2007 | Szieff | 173/20 |
| 7,392,593 | B2 | 7/2008 | Rivers et al. | |
| 2003/0057019 | A1 | 3/2003 | Schmitt et al. | |
| 2005/0173189 | A1 | 8/2005 | Berardi | |
| 2006/0032704 | A1 | 2/2006 | Chandra | |
| 2008/0006479 | A1 | 1/2008 | Mabry | |
| 2010/0224444 | A1 * | 9/2010 | Simeonov et al. | 182/18 |

OTHER PUBLICATIONS

Hsiao, H. et al. "Technologies for reducing fall risks associated with extension ladders", International Ergonomics Association Triennial Conference, Jul. 9-14, 2006, Maastricht, The Netherlands.

* cited by examiner

*Primary Examiner* — Blair M. Johnson
(74) *Attorney, Agent, or Firm* — Gifford, Krass, Sprinkle, Anderson & Citkowski, P.C.

(57) ABSTRACT

A safety device for measuring and indicating the level of a ladder having rungs extending between a pair of elongated ladder rails, the safety device comprising a housing dimensioned to be inserted into one of the rungs of the ladder, an electronic sensor disposed in the housing, a controller disposed in the housing, which is in electronical communication with the sensor, at least one indicator, and a power supply for supplying power to the device. The electronic sensor measures the inclination of the ladder to produce a measured inclination which the controller compares to a stored predetermined level value to produce a comparison signal. The at least one indicator receives the comparison signal and indicates to the user the comparison signal.

17 Claims, 2 Drawing Sheets

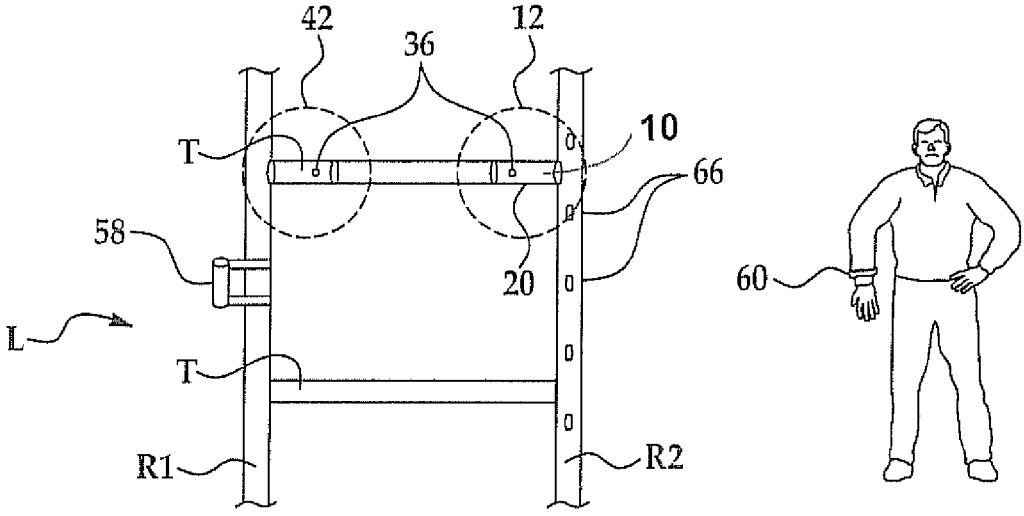
FIG. 1
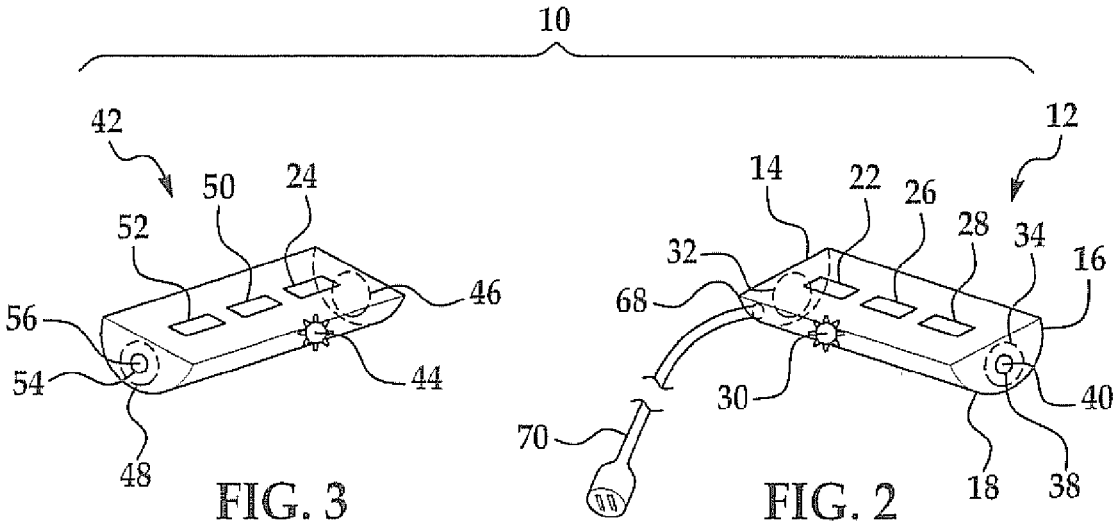
FIG. 3
FIG. 2
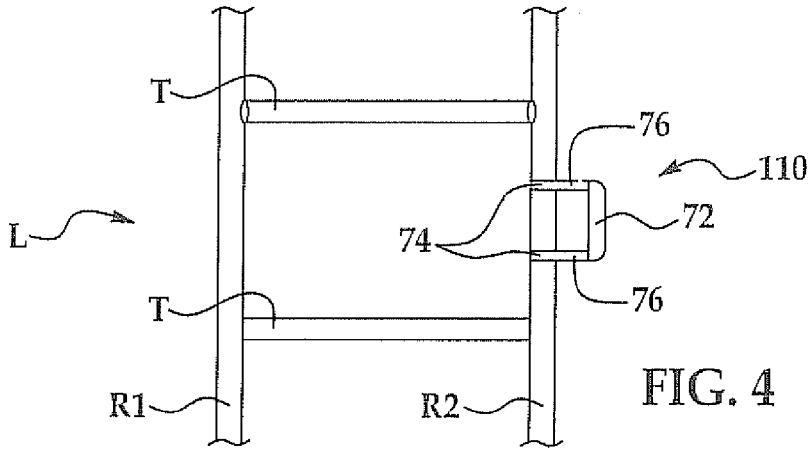
FIG. 4

MULTIMODAL INDICATOR SAFETY DEVICE FOR LADDER POSITIONING

GOVERNMENT INTEREST

The invention described herein may be manufactured, used, and licensed by or for the United States Government.

FIELD OF THE INVENTION

The present invention relates to a safety device for detecting the inclination of a ladder and to indicate to a user when the ladder is positioned at a safe inclination.

BACKGROUND OF THE INVENTION

The improper positioning of a ladder is one of the major causes of ladder-related accidents, which could result in injury to a ladder user. Mechanical ladder levels such as spirit/bubble levels or weighted pendulums can be attached to the ladder rail to measure the longitudinal inclination of the ladder; however, this requires a conscious effort by a user that is omitted on occasions. The position of a mechanical level is usually the outward face of the ladder. Therefore, the mechanical level cannot be observed by a user who is in a position to begin ascending the ladder, which is also the easiest position for a user to reposition a ladder. Further, as mechanical levels provide only passive indication as to the inclination of the ladder, even if a mechanical level is attached to the ladder it can be easily ignored by the user.

The passive indication afforded by mechanical levels ultimately results in a series of checks and corrections of the ladder position every time the ladder is moved. The series of check and correct cycles can be a factor in the degradation of work productivity or safety. If proper ladder positioning procedures are followed, the numerous check and correct cycles can prematurely fatigue the user resulting in a decrease in productivity. However, if the proper ladder positioning procedures are ignored the risk of ladder related accidents increases.

In addition, as the mechanical level must be positioned on the exterior of the ladder to be visible the level is exposed to the rugged conditions surrounding most ladder use and is subject to being damaged or broken.

Thus, there exists a need for a safety device which can actively indicate the inclination of the ladder to a user positioned to begin ascending the ladder without compromising work productivity or safety, and which is protected against being damaged or destroyed.

SUMMARY OF THE INVENTION

The present invention provides a multimodal indicator safety device for ladder positioning which overcomes the above-mentioned disadvantages of the previously known ladder positioning indicators.

In brief, a multimodal indicator safety device for ladder positioning indicates the longitudinal inclination and/or the lateral tilt of a ladder to a user in a position to begin ascending the ladder and is protected from external impacts. The ladder has a pair of elongated ladder rails, with rungs extending between the ladder rails. The safety device has a power supply, and a housing dimensioned to be inserted into one of the rungs of the ladder. The housing contains a controller and an electronic sensor in electronic communication with a controller. The electronic sensor measures the inclination of the ladder to produce a measured inclination, and communicates the measured inclination to the controller. The controller compares the measured inclination to a predetermined level value stored in the controller, to produce a comparison signal.

The safety device further includes at least one indicator, such as a visual or audio alarm, or a vibration pad, which indicates to the user the comparison signal. The indicated comparison signal indicates to a user whether or not the inclination of the ladder is within a predetermined range relative to the predetermined level value. In this manner, the inclination of the ladder is actively indicated to a user.

BRIEF DESCRIPTION OF THE DRAWINGS

FIG. 1 is a front elevational view illustrating a multimodal safety device, according to the present invention, when disposed within a ladder;

FIG. 2 is a front perspective view illustrating the encircled first housing of the multimodal safety device depicted in FIG. 1;

FIG. 3 is a front perspective view illustrating the encircled second housing of the multimodal safety device depicted in FIG. 1;

FIG. 4 is a front perspective view illustrating the housing of the multimodal safety device shaped of an ergonomic handle is secured to the exterior of elongated ladder;

DETAILED DESCRIPTION OF THE INVENTION

Figure 5:
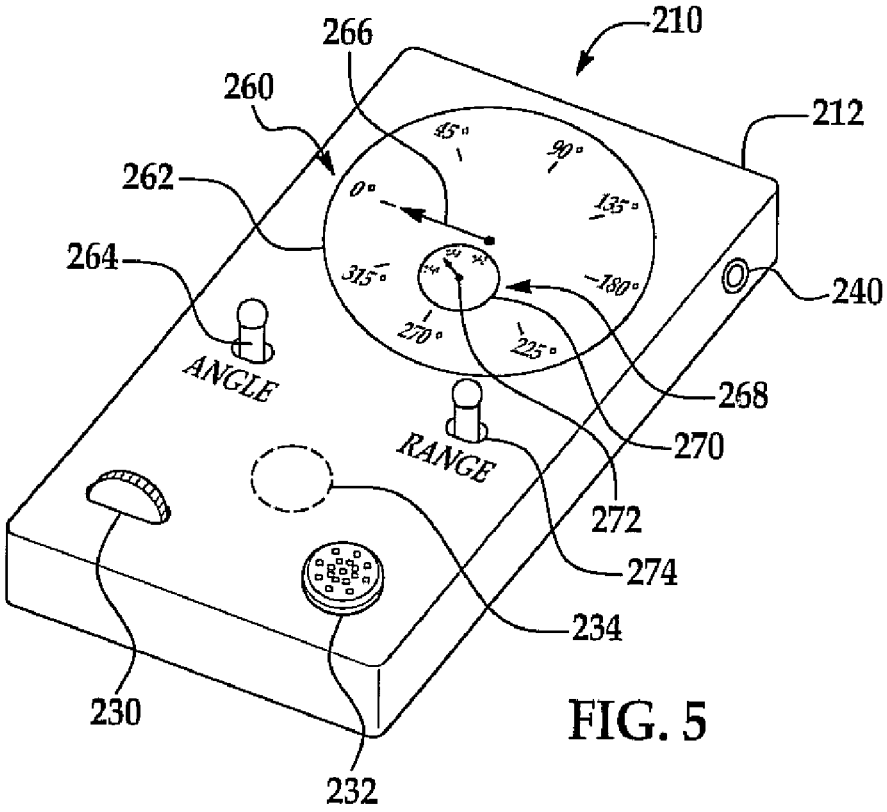
FIG. 5 is a perspective view of an analog hand-held of an inventive safety device.

The present invention has utility as a multimodal indicator safety device for ladder positioning which overcomes the above-mentioned disadvantages. By using an electronic sensor to measure the inclination of the ladder the safety device can be inserted into the interior core of one of the rungs of the ladder to protect the sensor against impact associated with the external environment. Further, through the use of an electronic sensor the safety device not only indicates to a user when the ladder is properly inclined but also actively indicates to the user in which direction the ladder must be moved in order to properly incline the ladder. The inventive indicator is also operative even if the user is in a position to begin ascending the ladder. The directional indication is accomplished through the use of a number of different indicators, such as an audio or visual alarm or a vibration pad.

With reference to FIGS. 1, 2, and 3, an inventive multimodal safety device is illustrated generally at 10. The safety device 10 is configured to be used with a ladder L which includes a pair of spaced apart parallel ladder rails R1 and R2 with rungs T extending between the ladder rails R1 and R2. The ladder L depicted in the figures is of the type known as an extension ladder having a top ladder section which is slidably engageable with a bottom ladder section so as to extend the overall length of the ladder L. However, it is appreciated that the safety device 10 is not limited in use to the ladder depicted in the figures or described in the specification and is operative in any ladder or similar tool, illustratively including scaffolding, and A-frame ladders.

The safety device 10 has an elongated housing 12 having a distal end 14, and a proximate end 16. The housing 12 is dimensioned to insert into one of the rungs T of the ladder L, with the distal end 14 being inserted into the rung T first, and the proximate end 16 being adjacent to one of the ladder rails R1 and R2 when inserted. Ladder rungs T are hollow and typically have a semi-circular cross section with a flattened portion so as to provide a stable footing surface. The flattened portion is parallel to the horizontal ground surface when the ladder L is properly inclined. The housing 12 is dimensioned to be complementary in shape to the hollow rung T in which it is inserted. As such, the housing 12 is inserted at a specific angle relative to the elongated ladder rails R1 and R2. Therefore, the housing 12 is provided with a relative orientation from which to measure the inclination of the ladder L.

The safety device 10 optionally includes an orientation tab 18 which engages a complementary orientation groove 20. As depicted, the orientation tab 18 is located on the housing 12 and the orientation groove 20 is located on the hollow rung T. However, the tab 18 and groove 20 are not limited to those locations, and may be of any type or design known to those of ordinary skill in the art for aligning one object with respect to another object. When the orientation tab 18 is engaged with the orientation groove 20, the safety device 10 is provided with a relative orientation from which to measure the inclination of the ladder L.

The housing 12 further includes an electronic sensor 22 for measuring the longitudinal inclination of the ladder L. The electronic sensor 22 detects and communicates inclination based on a liquid movement switch, inclinometers, or accelerometers. Preferably, the sensor 22 is based on solid state electronics. The electronic sensor 22 optionally measures both the longitudinal inclination and the lateral tilt of the ladder L from the relative orientation provided by the orientation tab 18 and the orientation groove 20. In the alternative, the housing 12 contains a second electronic sensor with the first electronic sensor 22 measuring the longitudinal inclination of the ladder L and the second electronic sensor measuring the lateral tilt of the ladder L. It is appreciated that the two-dimensional inclination of the two sensors affords correct planar positioning as to both inclination and tilt of a ladder in a way not previously performed by the prior art.

Further included in housing 12 is a controller unit 26 Which compares the measured longitudinal inclination and the measured lateral tilt with a predetermined level value which is stored in the controller unit 26. The controller unit 26 is provided with a predetermined level value for both the longitudinal inclination of the ladder and the lateral tilt of the ladder. Preferably, the values represent the recommended inclinations of a ladder governed by the OSHA and/or ANSI standards. The controller unit 26 receives an input from the electronic sensor 22, and/or second electronic sensor, and compares the longitudinal inclination input to the predetermined longitudinal inclination value and the lateral tilt input to the predetermined lateral tilt value. Controller unit 26 determines whether the present inclination and tilt of the ladder is within an acceptable range of the predetermined level values. Preferably, an acceptable inclination or tilt is within .+−.2.degree. of the predetermined level values.

The safety device 10 further includes a power supply 28 for supplying power to the safety device 10. The power supply 28 illustratively is a battery disposed within the housing 12 of the safety device 10, a solar cell attached to the exterior of the ladder L, or a combination thereof.

As seen in FIGS. 1 and 2 safety device 10 includes at least one of a visual indicator 30, such as a light emitting diode (LED), an audio indicator 32, such as a loudspeaker, and a vibration pad 34, for indicating to the user the inclination and/or the tilt of the ladder L. While in the FIGS. the audio indicator 32, if present, is depicted as located at the distal end 14 of the housing 12 and the vibrator pad 34, if present, is located at the proximate end 16 of the housing 12, it is appreciated that other configurations are operative and intended to be encompassed by the present invention. The visual indicator 30, if present, is located along the longitudinal direction of the housing 12 between the two ends 14 and 16. Preferably, the indicators 30, 32 and 34 are all present.

It will be appreciated from FIG. 1 that the hollow rung T in which the safety device 10 is inserted includes an aperture 36 which corresponds to the location of the visual indicator 30 when inserted into the hollow rung T. The aperture 36 faces the front face of the ladder L so that the visual indicator 30 is visible to a user when the user is facing the front face of the ladder L. As such, it is preferable that the housing 12 is inserted into a hollow rung T which is at or near eye level for an adult male of average height. The housing 12 also includes a power switch 38 for turning the safety device 10 on and off, located at the proximate end 16. The power switch 38 optionally includes an auto switch which turns the safety device 10 on in response to the ladder being positioned in the vertical direction or movement of the ladder. The housing 12 optionally includes a mode switch 40 which allows a user to select the mode of operation for the safety device 10.

Two optional modes of operation selected with the switch 40 are a power saving setup mode and a continuous monitoring warning mode. In the setup mode the safety device 10 provides the user with varying indications, through the use of the indicators 30, 32 and 34 or any combination thereof, as to the inclination, and optionally the tilt, of the ladder L until the inclination, and optionally the tilt, equals the predetermined level value, preferably, for a predetermined period of time. Maintaining level for the predetermined period of time accounts for setting and user weighting mass induced level changes. The varying indications allow the user to get continuous feedback as to the inclination and optionally tilt of the ladder L until the ladder L is correctly positioned for a predetermined period of time, at which point the safety device 10 will automatically shut off.

In the continuous warning mode, the safety device 10 initially operates in the same manner as the setup mode, however, the safety device 10 does not automatically turn off after the measured inclination, and optionally the tilt, of the ladder L is within the predetermined level value range for a predetermined period of time. Rather, in the warning mode the safety device 10 continuously monitors the inclination and optionally the tilt of the ladder L and will warn the user if The inclination or the tilt of the ladder L shifts to no longer be within a predetermined range of the predetermined level value.

As the safety device 10 lacks the conventional exposed inclination sensor, such as a spirit/bubble level, operational lifetime is increased and misalignment indication is enhanced in optionally communicating the direction the ladder L must be moved to achieve a safe inclination and/or tilt. Through the use of an indicator 30, 32 and/or 34. The safety device 10 is able to indicate to the user in which direction the ladder L is moved in to be properly inclined and/or tilted.

To accomplish corrective movement towards safe ladder alignment, at least one of the indicators 30, 32 and 34 are configured to provide a number of different indications to the user depending upon whether the inclination of the ladder L is below the predetermined level value range, within the predetermined level value range, or above the predetermined level value range. The indicators 30, 32 and 34 receive a signal from the controller 26 instructing at least one of the indicators 30, 32 or 34 when and what type of indication should be indicated to the user. Examples of such are as follows.

The visual indicator 30 is optionally a different color emission depending upon the inclination of ladder L, such as, "green" when the inclination of the ladder L is within the predetermined level value range, "red" when the inclination of the ladder L is above the predetermined level value range, and "yellow" when the inclination of the ladder L is below the predetermined level value range.

In addition to changing color, the visual indicator 30 also optionally blinks to indicate to the user the amount in which ladder must be moved to be properly inclined, such as a proportional blink rate to the degrees of movement needed. The frequency of the blinks is alternatively inversely proportional to the amount of change of inclination and/or tilt that is required to properly level the ladder L, such that the closer the inclination and/or tilt of the ladder L is to the predetermined level value range the faster the visual indicator 30 blinks.

The audio indicator 32 optionally has a synthesized voice which states the direction of movement required in order to properly incline the ladder L. In the alternative, the audio indicator 32 emits different sounds depending upon the inclination and/or tilt of ladder L, such as a first sound when the inclination and/or tilt of the ladder L is within the predetermined level value range, a second sound when the inclination and/or tilt of the ladder L is above the predetermined level value range, and a third sound when the inclination and/or tilt of the ladder L is below the predetermined level value range.

In addition to emitting different sounds, the audio indicator 32 also optionally varies the loudness or frequency of the sound to indicate to the user the amount or direction in which the ladder L must be moved to be properly leveled. The frequency of the emitted sounds is alternatively inversely related to the amount of change that must be made to properly level the ladder L, such that the closer the inclination and/or tilt of the ladder L is to the predetermined level value range, the faster the audio indicator 32 emits the sound. The loudness of the emitted sound is also optionally directly related to the amount of change of inclination and/or tilt that must be made to properly level the ladder L, such that the closer the inclination and/or tilt of the ladder L is to the predetermined level value range the quieter the audio indicator 32 emits the sound.

The vibrator pad 34, if present, uses different types of vibrations depending upon the inclination and/or tilt of ladder L, such as a first vibration type when the inclination and/or tilt of the ladder L is within the predetermined level value range, a second vibration type when the inclination and/or tilt of the ladder L is above the predetermined level value range, and a third vibration type when the inclination and/or tilt of the ladder L is below the predetermined level value range.

In addition to emitting a different vibration type, the vibrator pad 34 could also vary the intensity or frequency of the vibration to indicate to the user the amount in which ladder L must be moved to be properly leveled. The frequency of the vibration could be directly related to the amount of change of inclination and/or tilt that must be made to properly level the ladder L, such that the closer the inclination and/or tilt of the ladder L is to the predetermined level value range the slower the vibrator pad 34 vibrates. The intensity of the vibration is also optionally directly related to the amount of change of inclination and/or tilt that must be made to properly level the ladder L, such that the closer the inclination and/or tilt of the ladder L is to the predetermined level value range the weaker the vibrator pad 34 vibrates.

It will be appreciated that the above described examples are for the purpose of illustration and shall not be considered limiting in any way. It is also appreciated that the indicators are not limited to the type of indicators described above. Further, the locations of the indicators are not limited to the housing 12, and can be wirelessly connected to the controller unit 26. One of the indicators, optionally, is located in a handle 58 attached to the exterior of ladder rail R1. The handle 58 provides a user with a secure grip while adjusting the ladder L to a proper level. In the alternative, one of the indicators is, optionally, disposed in an article 60, illustratively including a bracelet or a pager, which is attached to the user. The article 60 includes a receiver such that the indicator is in wireless communication with the safety device 10. A user having an article 60 with an indicator is capable of receiving an indication of the level of the ladder L regardless of the position of the user relative to the ladder L.

The indicators are also optionally formed integral with the ladder L, such as a multiple of LED lights 66 extending along the longitudinal direction of ladder rails R1 and R2 so as to provide the user with a visual indication of the inclination of the ladder L regardless of how far up the user has scaled the ladder L.

The safety device 10 is optionally interfaced as an interrupt switch for various electronic devices, such as a radio, MP3 player, or other digital recording players. As an example, the safety device 10 has an interrupter switch 68 and a power plug 70 that would prevent power from activating a radio or other device plugged in thereto until the inclination of ladder L is within the predetermined level value range for a predetermined amount of time. In this way, a user will not hear a sound program until the ladder L is safely positioned.

The safety device 10 optionally includes a second housing 42 which houses the second electronic sensor 24 and includes a second visual indicator 44, a second audio indicator 46, a second vibrator pad 48, a second controller unit 50, a second power supply 52, a second power switch 54 and a second mode switch 56, as seen in FIG. 3. The first housing 12 and the second housing 42 are separate and independent from each other. The first housing 12 measures and indicates to the user, using first indicators 30, 32 and 34 or any combination thereof, the longitudinal inclination of the ladder L in the above described manner and the second housing 42 is used to measure and indicate to the user, using second indicators 44, 46 and 48 or any combination thereof, the lateral tilt of the ladder L in the above described manner. In the alternative, the first housing 12 and the second housing 42 are operably connected to each other such that the longitudinal inclination and the lateral tilt of the ladder L can be indicated to the user through a combination of the first indicators 30, 32, and 34, and the second indicators 44, 46, and 48, in the above described manner.

Referencing FIG. 4, an alternative configuration of the safety device 110 is illustrated. A housing 72 in the shape of an ergonomic handle is secured to the exterior of elongated ladder rail R2 through the use of a pair of clips 74 positioned at each end of the housing 72. It will be appreciated that the term clips encompasses any of the various devices that are capable of gripping, clasping or hooking either fixedly or releasably. Each of the pair of clips 74, optionally, includes an elongated portion 76 in order to space the housing 72 apart from the elongated ladder rail R2 to facilitate in the gripping of the handle shaped housing 72 by a user.

The safety device 110 differs only from the above described safety device 10 in the configuration of the housings. The remaining components of the safety device 110 and its operation are identically to the above described safety device 10.

Referring to FIG. 5 another alternative configuration of the safety device is generally illustrated at 210. The safety device 210 is a portable version of previously described safety devices and is capable of a wide range of applications requiring the positioning of objects at varying angles. Such applications illustratively include construction, masonry building/repair or any other situations which requires the alignment of an object at a specific angle or in which the angles of several objects are required to be identical.

The safety device 210 includes a housing 212 which is dimensioned to be held either one hand or both hands of an average adult male. At least one side of the housing 212 has a smooth flat surface so as to provide a solid contact between the safety device 210 and the surface of the object which angle is to be measured.

The safety device 210 includes all of the components of the previously described safety devices which operate in a similar manner, including an electronic sensor, a controller unit, a power supply, a mode switch 240 and at least one of a visual indicator 230, an audio indicator 232, and a vibration pad 234. The main difference between the previously described safety devices and the safety device 210 is that the predetermined inclination is not fixed. Rather, the predetermined inclination is variable by the user to produce a selected inclination.

An angle selector 260 allows the user to operatively select the selected inclination which is to be compared to the measured inclination as described above. In FIG. 5, the angle selector 260 includes an angle gauge 262 having a plurality of indicia representing angles ranging from 0 degrees to ±90 degrees, although the scale and range of the angles may be varied according to the particular application. A pointer 264 controlled by a dial 266, operated by the user, is aligned with the indicia of gauge 262 representing the desired inclination which is used as the selected inclination.

The angle selector 260 is in electronic communication with the controller such that the angle selected by the user with the pointer 264 is received by the controller. The selected inclination is converted into a selected inclination range and then compared to the measured inclination, as in the previously described safety devices, to produce a comparison signal that is indicated to the user by at least one of a visual indicator 230, an audio indicator 232 and/or a vibration pad 234.

The safety device 210 optionally includes a range selector 268 which allows the user to select an acceptable range relative to said control inclination. The controller converts the selected inclination into the selected inclination range based upon input from the range selector 268. The range selector 268 may be of similar construction as the angle selector 260, with a range gauge 270 having a plurality of indicia representing different acceptable ranges, and a range pointer 272 which is operated by a range dial 274. In such a configuration, the controller converts the selected inclination into the selected inclination range based upon input from the range selector.

Figure 6:
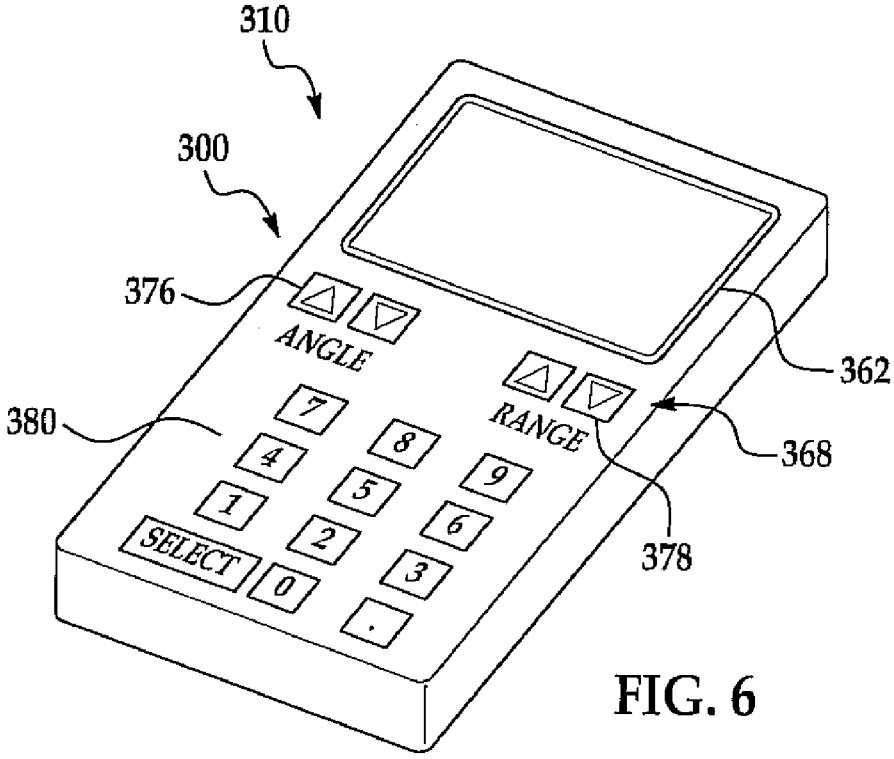
FIG. 6 is a perspective view of a digital hand-held of an inventive safety device.

Referring now to FIG. 6, an alternative configuration of the safety device 210 of FIG. 5 is illustrated at 310. The angle selector 360 of safety device 310 of FIG. 6 has a digital display 362 rather than a dial and gauge configuration. The user can enter either the selected inclination and/or the selected range through angle control buttons 376, range control buttons 378, or keypad 380. It is appreciated that that the device 210 can be configured as a personal digital assistant inclusive of the aforementioned indicators and inclinometer and/or an accelerometer.

The digital display 362 is capable displaying the measured inclination, the selected inclination, the range, and the selected inclination range. Further, the digital display 362 is capable of acting as the visual indicator by indicating the comparison signal in any of the above identified manners.

In the alternative, the safety device 210 and 310 are capable of selecting the selected inclination by measuring the actual inclination of the safety device through the use of the electronic sensor. The user would align the safety device with a surface or angle to be measured, and then by actuating the angle selector the electronic sensor would measure the inclination. The measured inclination would be stored in the controller as the selected inclination. After storing the measured inclination as the selected inclination in the controller unit, the selected inclination can be recalled and used at a later time. Further, several selected inclinations could be stored in the controller for later use, thus allowing for the user to have a multitude of user measured inclinations available for use as the selected inclination.

It will be appreciated that the angle selector is not limited to the above described selectors. Rather, the angle selector may encompasse any device or configuration known to those of ordinary skill in the art which would allow a user to select a specific angle to be compared to the measured inclination.

In addition, the safety devices illustrated in FIGS. 5 and 6 are capable of measuring more than one angle. The safety devices may include one or two additional electronic sensor, for measuring two or three angles respectively, or one electronic sensor capable of measuring one or two additional angles. In such a configuration the safety devices include an angle selector for each measured inclination or an angle selector capable of selecting a selected inclination for each measured inclination. This allows the user to select a three dimensional angle in space and have the safety device measure and indicated the position of the safety device relative to the selected three dimensional angle.

The housings 12, 42, 72, 212, and 312 are made of any conventional material such as metal, plastics, fiberglass, or the like. The housings 12, 42, 72, 212, and 312 can be constructed to be shockproof so as to protect the housings 12, 42, 72, 212, and 312, and their contents from being damaged. In addition, the housings 12, 42, 72, 212, and 312 can be made watertight so as to protect the components of the housings 12, 42, 72, 212, and 312 from the elements and other hazards associated with the use of the ladder L.

From the foregoing, it can be seen that the present invention provides a multimodal ladder safety device that can guide a user to incline the ladder at a proper inclination, indicate to the user when the ladder is inclined at the proper inclination and could warn a user when the ladder is no longer inclined at the proper inclination. Having described my invention, however, many modifications thereto will become apparent to those skilled in the art to which it pertains without deviation from the spirit of the invention as defined by the scope of the appended claims.

It is claimed:

1. A ladder with a safety device for measuring and indicating the level of the ladder, comprising:

a pair of elongated ladder rails;

a plurality of parallel rungs each extending between and interconnecting the elongated rails;

a housing inserted into one of the rungs of the ladder;

an electronic sensor for measuring the inclination of the ladder to produce a measured inclination, said sensor disposed in said housing;

a controller in electronic communication with said sensor, said controller having a predetermined level value stored therein, said controller comparing said predetermined level value to the measured, inclination to produce a comparison signal;

at least one indicator receiving the comparison signal and indicating to a user the comparison signal; and a power supply for supplying power to said device.

2. The ladder of claim 1, wherein said at least one indicator indicates to a user when the measured inclination of the ladder is within a predetermined range relative to the predetermined level value.

3. The ladder of claim 2, wherein said at least one indicator indicates to the user a first indication when said measured inclination is less than said predetermined range, a second indication when said measured inclination is equal to said predetermined range, and a third indication when inclination is greater than said predetermined range.

4. The ladder of claim 2, wherein said measured inclination includes a measured lateral tilt and a measured longitudinal inclination, and the predetermined level value comprises a predetermined lateral tilt and a predetermined longitudinal inclination.

5. The ladder of claim 4, further comprising a first indicator and a second indicator, said first indicator indicates to the user when said measured lateral tilt of the ladder is within the predetermined range, and said second indicator indicates to the user when the measured longitudinal inclination of the ladder is within the predetermined range.

6. The ladder of claim 5, wherein said first indicator indicates to the user a first indication when the measured lateral tilt of the ladder is less than the predetermined range, a second indication when the measured lateral tilt of the ladder is within the predetermined range, and a third indication when the measured lateral tilt of the ladder is greater than the predetermined range; and wherein said second indicator indicates to the user a first indication when the measured longitudinal inclination of the ladder is less than the predetermined range, a second indication when the measured longitudinal inclination of the ladder is within the predetermined range, and a third indication when the measured longitudinal inclination of the ladder is greater than the predetermined range.

7. The ladder of claim 5, further comprising a third indicator for indicating to the user when the measured lateral tilt is within the predetermined range and the measured longitudinal inclination is within the predetermined range.

8. The ladder of claim 2, wherein said safety device automatically shuts off after the measured inclination of the ladder is within the predetermined, range for a predetermined period of time.

9. The ladder of claim 1, wherein said electronic sensor is an inclinometer or accelerometer.

10. The ladder of claim 1 further comprising an interruptor switch preventing power from activating an audio player device.

11. The ladder of claim 1 further comprising a handle attached to one of the pair of elongated ladder rails, and wherein said at least one indicator is disposed in said handle.

12. A ladder with a safety device for measuring and indicating the level of the ladder, comprising:

a pair of elongated ladder rails;

a plurality of parallel rungs each extending between and interconnecting the elongated rails;

a first housing having a first electronic sensor for measuring the lateral tilt of the ladder to produce a measured lateral tilt, a first controller in electronic communication with said first sensor, said first controller having a predetermined lateral tilt range stored therein, said first controller comparing the predetermined lateral tilt range to the measured lateral tilt to produce a first comparison signal, and a first indicator for indicating to a user the first comparison signal; and a second housing having a second electronic sensor for measuring the longitudinal inclination of the ladder to produce a measured longitudinal inclination, a second controller in electronic communication with said second sensor, said second controller having a predetermined longitudinal inclination range stored therein, said second controller comparing the predetermined longitudinal inclination range to the measured longitudinal inclination to produce a second comparison signal, and a second indicator for indicating to a user the second comparison signal; and wherein said first housing and said second housing are inserted into opposite ends of one of the rungs of the ladder.

13. The ladder of claim 12, wherein said first housing further comprises a first audio indicator located at a first housing distal end, a first vibrator indicator located at a first housing proximate end opposite said first housing distal end, and a first visual indicator located between said first speaker indicator and said first vibrator indicator; and said second housing further comprises a second audio indicator located at a second housing distal end, a second vibrator indicator located at a second housing proximate end opposite said second housing distal end, and a second visual indicator located between said second speaker indicator and said second vibrator indicator;

wherein each of said first visual indicator and said second visual indicator are visible through the rang.

14. The ladder of claim 13, wherein said first visual indicator indicates to the user a first visual tilt indication when the measured lateral tilt is within the predetermined lateral tilt range, and a second visual tilt indication when the measured lateral tilt outside of the predetermined lateral tilt range; and wherein said second visual indicator indicates to the user a first visual inclination indication when the measured longitudinal inclination within the predetermined longitudinal inclination range, and a second visual inclination indication when the measured longitudinal inclination is outside of the predetermined longitudinal inclination range.

15. The ladder claim 13, wherein at least one of said first audio indicator and said first vibrator indicator indicates to the user when the measured lateral tilt shifts outside the predetermined lateral tilt range after being within the predetermined lateral tilt range for a predetermined period of time; and wherein at least one of said second audio indicator and said second vibrator indicator indicates to the user when the measured longitudinal inclination shifts outside the predetermined longitudinal inclination range after being within the predetermined longitudinal inclination range for a predetermined period of time.

16. The ladder of claim 12, wherein said first electronic sensor and said second electronic sensors are inclinometers or accelerometers.

17. The ladder of claim 12 further comprising an interruptor switch preventing power from activating an audio player device.

* * * * *

UNITED STATES PATENT AND TRADEMARK OFFICE

CERTIFICATE OF CORRECTION

PATENT NO. : 8,167,087 B2
APPLICATION NO. : 12/400233
DATED : May 1, 2012
INVENTOR(S) : Peter Simeonov et al.

It is certified that error appears in the above-identified patent and that said Letters Patent is hereby corrected as shown below:

At column 2, line number 24 after handle insert --which--.

At column 2, line number 24 delete “of” insert --as--.

At column 2, line number 25 after of insert --the--.

At column 3, line number 37 delete “Which” insert --which--.

At column 3, line number 52 delete “degree.” insert --degrees--.

At column 4, line number 42 after if delete “The” insert --the--.

Signed and Sealed this
Sixth Day of November, 2012

David J. Kappos

David J. Kappos
*Director of the United States Patent and Trademark Office*